United States Patent [19]

Hinck

[11] Patent Number: 4,681,639

[45] Date of Patent: Jul. 21, 1987

[54] PROCESS FOR TREATING AND CONVERTING OF ISO-GLUCOSE SIRUP

[75] Inventor: Karl-Heinz Hinck, Tornesch, Fed. Rep. of Germany

[73] Assignee: Starcosa GmbH, Brunswick, Fed. Rep. of Germany

[21] Appl. No.: 829,851

[22] Filed: Feb. 14, 1986

Related U.S. Application Data

[63] Continuation-in-part of Ser. No. 616,245, Jun. 1, 1984, abandoned.

[30] Foreign Application Priority Data

Jun. 8, 1983 [DE] Fed. Rep. of Germany ..... 3320602

[51] Int. Cl.[4] ..... C13F 1/02; C13F 3/00

[52] U.S. Cl. ..... 127/30; 127/60; 127/61; 127/63

[58] Field of Search ..... 127/30, 40, 41, 46.1, 127/58, 60, 61, 62, 15, 16, 63

[56] References Cited

U.S. PATENT DOCUMENTS 3,704,168 11/1972 Hara ..... 127/62 X 3,812,010 5/1974 Nitsch ..... 127/61 X 4,371,402 2/1983 Kubota ..... 127/61 X

*Primary Examiner*—Richard V. Fisher

*Assistant Examiner*—W. Gary Jones

*Attorney, Agent, or Firm*—W. G. Fasse; D. H. Kane, Jr.

[57] ABSTRACT

Iso-glucose sirup having a proportion of 42% to 45% by weight of fructose, is treated and converted into a flowable granular end product. For this purpose the sirup is concentrated by evaporation to have 70% to 77% of dry substance by weight. Then the concentrated sirup is crystallized by cooling, whereupon the crystal mass is separated from the mother liquor and aged. An after-crystallization takes place during the aging. Thereafter, the aged crystal mass is milled to have a particle size of about 10 to about 250 microns. The mother liquor is also concentrated by evaporation to have about 90% of dry substance by weight. Then the milled crystal mass and the concentrated mother liquor are mixed with each other, whereby drying and mixing take place simultaneously. The quantities of the two components being mixed are so adjusted that the resulting mixture or end product has a fructose content of maximally 42% to 45% by weight of the end product.

10 Claims, 1 Drawing Figure

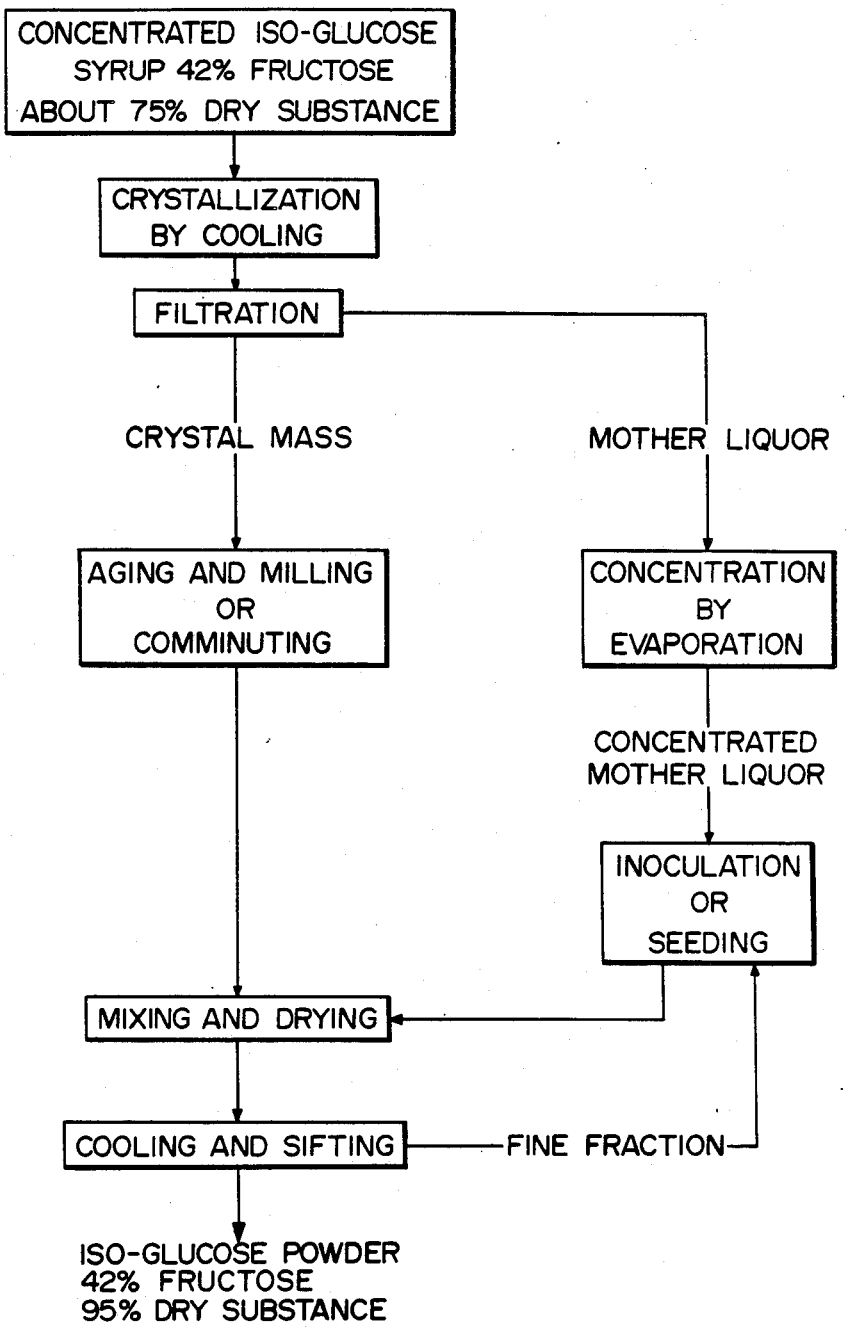
CONCENTRATED ISO-GLUCOSE SYRUP 42% FRUCTOSE ABOUT 75% DRY SUBSTANCE
CRYSTALLIZATION BY COOLING
FILTRATION
CRYSTAL MASS
MOTHER LIQUOR
AGING AND MILLING OR COMMINUTING
CONCENTRATION BY EVAPORATION
CONCENTRATED MOTHER LIQUOR
INOCULATION OR SEEDING
MIXING AND DRYING
COOLING AND SIFTING
FINE FRACTION
ISO-GLUCOSE POWDER 42% FRUCTOSE 95% DRY SUBSTANCE

PROCESS FOR TREATING AND CONVERTING OF ISO-GLUCOSE SIRUP

This application is a continuation-in-part of application Ser. No. 616,245, filed June 1, 1984, now abandoned.

FIELD OF THE INVENTION

The invention relates to a process for treating and converting of iso-glucose sirup to produce a flowable end product. The iso-glucose sirup contains a proportion of fructose of about 42% by weight of the iso-glucose sirup. Such sirup is first concentrated by evaporation so that the resulting concentrated sirup has a dry substance content of about 70 to 77% by weight of the concentrated sirup. Thereafter, the concentrated sirup is subjected to a crystallization by cooling, whereupon the crystalline glucose is separated from the mother liquor containing the fructose.

DESCRIPTION OF THE PRIOR ART

Methods are known in the art for enriching an iso-glucose sirup with fructose. In such a prior art process the crystalline glucose is fed back or returned into a dextrose sirup which is a precursor of the iso-glucose sirup. The precursor is then converted into the iso-glucose sirup by isomerization resulting from the addition of enzymes followed by concentration caused by evaporation. The following separations of the crystalline glucose from the concentrated iso-glucose sirup may be accomplished by centrifuging or even by filtering.

The resulting or obtained crystalline glucose is fed back into the dextrose sirup. Therefore, it is possible to leave the crystalline glucose in the form of a crystal paste or pulp which is introduced into the dextrose sirup.

The iso-glucose sirup produced from the dextrose sirup as described above by isomerizing and evaporating can be produced economically only with a fructose content of about 42% by weight. In this form or in the form resulting from the further separation of crystalline glucose, as described above, having a fructose content of minimum 55% by weight the iso-glucose sirup is used as a liquid sweetener, especially in the production of soft drinks.

In view of the above it is necessary that the iso-glucose sirup having a fructose content of 42% by weight must be stored and transported as a liquid product requiring respective containers. Additionally, it is necessary to keep the sirup, at least when it is required to be stored over prolonged periods of time, at such temperatures that a crystallization is avoided with certainty.

OBJECTS OF THE INVENTION

In view of the above it is the aim of the invention to achieve the following objects singly or in combination:

to provide a method or process of the type described above which is improved so that the just mentioned disadvantages of the iso-glucose sirup are avoided;

to convert an iso-glucose sirup by crystallization into a product which may be manufactured economically as a dry substance to greatly facilitate its storage and its transportation; and to provide a flowable dry product made of iso-glucose sirup, which product is suitable for use in all those instances where the iso-glucose is required to have a high dry substance content such as in bakery products, in preserves, and in confectionary and candy products.

SUMMARY OF THE INVENTION

According to the invention a flowable end product is produced by starting out with the process steps as described above, and by then continuing with the following steps. The crystal or crystalline mass to which mother liquor is still adhering is subjected to an aging process taking place for at least several hours, for example, from half an hour to seven hours. The aging is performed while keeping the crystal mass in a batch or pile of such a nature that it later permits the milling or comminuting when the aging is completed. An after-crystallization takes place during the aging. The aged crystalline mass is then comminuted or milled to produce a powder having a particle size in the range of about 10 to 250 microns. The mother liquor containing the fructose is concentrated by evaporation so that it will contain a dry substance proportion amounting to about 90% by weight of the concentrated mother liquor. The crystalline powder and the concentrated mother liquor are then mixed while simultaneously subjected to drying until a maximum content of fructose is achieved, amounting to about 42 to 45% by weight of the dry substance. After the mixing the mixture is kept in motion while it is being cooled and thereafter, the cooled mixture is sifted to produce said flowable final product. The process steps avoid the use of any organic solvents.

The crystal mass to which mother liquor is still adhering forms a crystal paste or pulp comprising dextrose monohydrate and dextrose in solution, as well as fructose and higher sugars, whereby the fructose proportion may amount up to 30% by weight of the crystalline dry substance. The drying and mixing of the comminuted or milled crystal powder with the concentrated mother liquor takes place by adding dosed quantities of the mother liquor to the crystalline powder at a temperature below 70° C. During the subsequent sifting a fine fraction is separated from the mixture and the fine fraction has a particle size in the range from 5 micron to a maximum particle size of 50 micron. The so separated fine fraction is then used for inoculating or seeding the concentrated mother liquor in a suitable manner for causing the mother liquor to begin crystallizing spontaneously when it is introduced into the crystal mass.

The invention is based on the recognition that the crystal mass to which mother liquor is still adhering is subject to an after-crystallization already during an aging of a few hours, said after-crystallization making a subsequent milling or comminuting of this substance possible to convert the substance into powder form. It has been found that in this connection it does not make any difference whether the crystal mass has been obtained by centrifuging or by filtering. It is merely important that mother liquor still adhering to the crystal mass is present, whereby such adhering mother liquor may amount to 5 to 15% by weight of the crystal mass and its presence facilitates the after-crystallization. It has been found that the crystal mass has a tendency to form a solid conglomerate during the after-crystallization. Therefore, it is important for the subsequent milling or comminution of the crystal mass subsequent to the after-crystallization, that the aging takes place in such batches or piles that they are easily breakable to provide an intermediate product which is easily millable or comminutable. A layer thickness during the aging in the range of 5 mm to 25 mm is satisfactory in this connection. The milling or comminution of the intermediate product to form the mentioned fine powder is done for the purpose of increasing the surface size. The desired flowable end product is obtained by the mixing of the concentrated and seeded or inoculated mother liquor having a dry substance of about 90% by weight, with the milled or comminuted crystal mass.

By the addition of the dosage of the concentrated mother liquor to the crystal powder it is possible to adjust the fructose proportion in the flowable end product within a wide range.

The flowable end product according to the invention is capable of prolonged storage and it may be kept in storage without any substantial expense in containers of a type which is conventionally used for the storage and transporting of flowable goods. In this context "flowable" means the ability of a granular bulk material to trickle or run down a chute or the like.

It has been found to be advantageous if the crystal mass to which the mother liquor is still adhering is kept in motion by revolving the crystal mass for a duration of up to 13 hours to achieve the aging and after-crystallization. Experience has shown that the revolving motion of the crystal mass facilitates the progress of the after-crystallization.

It has further been found to be advantageous if the mixing of the concentrated mother liquor into the crystal powder takes place in a vacuum or reduced pressure, preferably in the range of 100 mm Hg to 600 mm Hg. The drying during the mixing should also take place under such reduced pressure. Maintaining the vacuum or reduced pressure achieves an additional moisture removal so that the mother liquor can be added to the crystal powder in respectively or correspondingly larger doses per unit of time, whereby the mixing and drying of the two substances is accelerated and the entire process duration is reduced.

The addition of the concentrated mother liquor to the powdered crystal mass should take place in such measured quantities per unit of time that the mixture remains flowable at all times during the addition of the mother liquor.

BRIEF FIGURE DESCRIPTION

In order that the invention may be clearly understood, it will now be described, by way of example, with reference to the single FIGURE of the accompanying drawing showing a flow diagram of the present process.

DETAILED DESCRIPTION OF A PREFERRED EXAMPLE EMBODIMENT AND OF THE BEST MODE OF THE INVENTION

Iso-glucose sirup having a 42% by weight of fructose is concentrated by evaporation to have a 75% by weight dry substance content. The concentrated iso-glucose sirup is cooled, while stirring it, from 30° C. to 18° C., whereby it is subjected to a cooling crystallization. Following the crystallization by cooling, a filtration takes place as shown in the flow diagram. By starting with a batch of about 277 kilograms of sirup having a dry substance content of about 75% by weight one obtains 136 kilograms of crystal mass having a dry substance content of 80% by weight and about 30% by weight of fructose relative to the crystal mass dry substance, and 140 kilograms mother liquor having a fructose content of 55% by weight relative to the dry substance of the mother liquor and having a concentration of 71% by weight.

The crystal mass obtained by filtration is subjected to an aging for about 5 hours, whereby an after-crystallization takes place simultaneously while the mass is kept in motion by stirring until the crystal mass has a millable or comminutable consistency. After the aging and after crystallization, the mass is comminuted or milled to provide a particle size in the range of 10 micron to 250 micron.

The mother liquor obtained from the filtration is concentrated by evaporation to achieve a dry substance content of 90% by weight.

The concentrated mother liquor is inoculated or seeded with a fine fraction having an average particle size of about 20 micron.

This fine fraction is obtained by a sifting of the finished product. The so inoculated or seeded concentrated mother liquor is supplied into the crystal powder in predetermined doses, whereby the resulting mixture is stirred in a vacuum where it is simultaneously dried and subsquently cooled, whereby it is also kept in motion at all times. During the following sifting the above mentioned fine fraction is separated from the remaining substance and supplied into the mother liquor as a seeding or inoculating agent as described above.

The end product so obtained after the sifting and out of the mentioned quantity of iso-glucose sirup is an iso-glucose powder having a fructose content of 42% by weight and a moisture content of 5% by weight in a quantity of 219 kilograms of final or end product.

Although the invention has been described with reference to specific example embodiments, it will be appreciated that it is intended to cover all modifications and equivalents within the scope of the appended claims.

What is claimed is:

1. A process for treating and converting iso-glucose sirup to form a flowable dry end product, said iso-glucose sirup including fructose to the extent of about 42 to 45% by weight of the sirup, comprising the following steps:

(a) concentrating said iso-glucose sirup by evaporation to produce a concentrated sirup containing dry substance of about 70 to 77% by weight of the concentrated sirup;

(b) crystallizing said concentrated sirup by a first cooling step at a cooling temperature within the range of 30° C. to 18° C. to produce a predominantly glucose containing crystal mass;

(c) separting fructose containing mother liquor from said crystal mass;

(d) aging said crystal mass, to which mother liquor is still adhering, for at least several hours in a batch or pile for causing an after-crystallization to produce an aged crystal mass;

(e) comminuting or milling said aged crystal mass to form a crystal powder having a particle size in the range from about 10 micron to about 250 micron;

(f) concentrating said mother liquor containing said fructose, by evaporation to produce a concentrated mother liquor containing dry substance to the extent of about 90% by weight of the concentrated mother liquor;

(g) mixing said crystal powder and said concentrated mother liquor while simultaneously drying said crystal powder and concentrated mother liquor to produce a mixture containing maximally 42 to 45% of fructose by weight of dry substance;

(h) performing a second cooling step by cooling said mixture of step (g) while keeping said mixture in motion; and (i) sifting said mixture, said steps avoiding the use of any organic solvents to produce said dry flowable end product.

2. The process of claim 1, wherein said aging step takes place over a time period of half an hour to 7 hours.

3. The process of claim 1, wherein said second cooling step of said mixture takes place at a temperature within the range of 30° C. to 18° C.

4. The process of claim 1, wherein said aging of said crystal mass takes place while revolving the crystal mass for a duration of at least half an hour to about 13 hours for accomplishing said after-crystallization.

5. The process of claim 1, further comprising producing by said sifting step a fine fraction having a particle size within the range of 5 micron to 50 micron, inoculating or seeding said concentrated mother liquor with said fine fraction so that said concentrated mother liquor begins to crystallize spontaneously during said mixing of the crystal powder with the concentrated and inoculated or seeded mother liquor.

6. The process of claim 1, wherein said step of mixing of said crystal powder and said concentrated mother liquor is performed under a reduced pressure in the range of 100 mm Hg to 600 mm Hg, and further comprising drying the mixture while it is being mixed under said reduced pressure.

7. The process of claim 1, wherein said step of mixing said crystal powder and said concentrated mother liquor is performed by adding such quantities of concentrated mother liquor per unit of time to said crystal powder that the mixture remains flowable during the adding of the concentrated mother liquor during mixing.

8. The process of claim 1, comprising providing a batch of fixed quantity of said iso-glucose sirup, and mixing the entire amount of crystal powder and the entire amount of concentrated mother liquor, resulting from said batch of fixed quantity, with each other.

9. The process of claim 1, wherein said batch or pile has a layer thickness in the range of 5 millimeter to 25 millimeter to facilitate the braking up of the pile for said comminuting or milling step.

10. A process for treating and converting iso-glucose sirup to form a flowable dry end product, said iso-glucose sirup including fructose to the extent of about 42 to 45% by weight of the sirup, comprising the following steps;

(a) concentrating said iso-glucose sirup by evaporation to produce a concentrated sirup containing dry substance of about 70 to 77% by weight of the concentrated sirup;

(b) crystallizing said concentrated sirup by cooling at a cooling temperature within the range of 30° C. to 18° C. to produce a predominantly glucose containing crystal mass;

(c) separating fructose containing mother liquor from said crystal mass;

(d) aging said crystal mass, to which mother liquor is still adhering, for at least several hours in a batch or pile for causing an after-crystallization to produce an aged crystal mass;

(e) comminuting or milling said aged crystal mass to form a crystal powder having a particle size in the range from about 10 micron to about 250 micron;

(f) concentrating said mother liquor containing said fructose, by evaporation to produce a concentrated mother liquor containing dry substance to the extent of about 90% by weight of the concentrated mother liquor;

(g) mixing said crystal powder and said concentrated mother liquor while simultaneously drying said crystal powder and concentrated mother liquor to produce a mixture containing maximally 42 to 45% of fructose by weight of dry substance;

(h) cooling the mixture while keeping the mixture in motion; and (i) sifting the mixture including a fine fraction having a particle size within the range of 5 micron to 50 micron, inoculating or seeding said concentrated mother liquor with said fine fraction so that said concentrated mother liquor begins to crystallize spontaneously during said mixing of the crystal powder with the concentrated and inoculated or seeded mother liquor, said steps avoiding the use of any organic solvents to produce said flowable dry end product.

* * * * *